US010469951B2

(12) United States Patent
Morgan et al.

(10) Patent No.: US 10,469,951 B2
(45) Date of Patent: Nov. 5, 2019

(54) LOUDSPEAKER MAGNET AND EARPHONE ASSEMBLY

(71) Applicant: Correlated Magnetics Research, LLC, Huntsville, AL (US)

(72) Inventors: Jason N. Morgan, Brownsboro, AL (US); Andrew James Keane, Los Altos, CA (US); Micah Brandon Harvey, Madison, AL (US); Christopher David Pittman, Huntsville, AL (US); Robert Lyle Coates, Huntsville, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 0 days.

(21) Appl. No.: 15/947,017

(22) Filed: Apr. 6, 2018

(65) Prior Publication Data

US 2018/0295449 A1 Oct. 11, 2018

Related U.S. Application Data

(60) Provisional application No. 62/483,006, filed on Apr. 7, 2017, provisional application No. 62/629,539, filed on Feb. 12, 2018.

(51) Int. Cl.
*H04R 9/00* (2006.01)
*H04R 9/02* (2006.01)
(Continued)

(52) U.S. Cl.
CPC ..... *H04R 9/025* (2013.01); *H04R 1/105* (2013.01); *H04R 1/2815* (2013.01); *H04R 7/04* (2013.01);
(Continued)

(58) Field of Classification Search
CPC ..... H04R 9/00; H04R 9/025; H04R 9/027; H04R 7/06
(Continued)

(56) References Cited

U.S. PATENT DOCUMENTS 4,965,836 A 10/1990 Andre et al.
7,499,555 B1 * 3/2009 Isvan ..... H04R 1/1075 381/182
(Continued)

FOREIGN PATENT DOCUMENTS

TW 524028 U 6/2016

OTHER PUBLICATIONS

"International Application Serial No. PCT/US2018/026418, International Search Report dated Jul. 6, 2018", 2 pgs.
(Continued)

*Primary Examiner* — Suhan Ni
(74) *Attorney, Agent, or Firm* — Schwegman Lundberg & Woessner, P.A.

(57) ABSTRACT

A dual-diaphragm loudspeaker driver assembly can include a multiple pole magnet structure, and first and second pole piece assemblies can be provided on opposite first and second sides of the multiple pole magnet structure. In an example, each pole piece assembly defines an airgap over a polarity transition region on a respective side of the magnet structure. First and second voice coils can be provided in respective ones of the airgaps, wherein each of the voice coils is coupled to a respective diaphragm assembly, and at least one acoustic tuning port can be configured to provide a damped acoustic communication path between first and opposite second sides of each diaphragm assembly.

20 Claims, 11 Drawing Sheets

(51) Int. Cl.

| | |
|---|---|
| ***H04R 1/28*** | (2006.01) |
| ***H04R 1/10*** | (2006.01) |
| ***H04R 7/04*** | (2006.01) |
| ***H04R 9/06*** | (2006.01) |
| *H04R 5/033* | (2006.01) |

(52) U.S. Cl.
CPC ..... *H04R 9/063* (2013.01); *H04R 1/1008* (2013.01); *H04R 1/2826* (2013.01); *H04R 1/2896* (2013.01); *H04R 5/033* (2013.01)

(58) Field of Classification Search
USPC ..... 381/396, 412, 421, 424
See application file for complete search history.

(56) References Cited

U.S. PATENT DOCUMENTS

| | | | | |
|---|---|---|---|---|
| 7,539,318 | B2 * | 5/2009 | Onuma | H04R 1/323 381/182 |
| 8,670,585 | B2 * | 3/2014 | Valtchev | H04R 1/227 381/182 |
| 2009/0190791 | A1 | 7/2009 | Unruh et al. | |
| 2014/0056466 | A1 | 2/2014 | Jenq | |
| 2016/0212545 | A1 | 7/2016 | Morgan et al. | |

OTHER PUBLICATIONS

"International Application Serial No. PCT/US2018/026418, Written Opinion dated Jul. 6, 2018", 6 pgs.

* cited by examiner

LOUDSPEAKER MAGNET AND EARPHONE ASSEMBLY

CLAIM OF PRIORITY

This application claims the benefit of priority of Morgan et al., U.S. Provisional Patent Application Ser. No. 62/483,006, filed on Apr. 7, 2017, which is herein incorporated by reference in its entirety, and this application claims the benefit of priority of Morgan et al., U.S. Provisional Patent Application Ser. No. 62/629,539, filed on Feb. 12, 2018, which is herein incorporated by reference in its entirety.

BACKGROUND

Stereo headphone assemblies vary widely in their frequency response, comfort to a listener, and aesthetic design. In some examples, a stereo headphone is configured for high fidelity sound reproduction, that is, for faithfully and accurately reproducing sound information over all or a substantial part of the acoustic audio spectrum.

In some examples of stereo headphones, single loudspeaker drivers are used in each of two earcup assemblies. Such single-driver designs are often inadequate to discerning listeners due to compromises in either a low frequency response or a high frequency response of the selected driver design. In some examples, multiple drivers are used in each of two earcup assemblies, such as with a crossover filter to route different frequency signals to different drivers. Such multiple-driver headphone assemblies are typically bulky, heavy, and difficult to manufacture. Furthermore, they can suffer from undesirable distortion or phasing when multiple drivers feed a common, closed airspace adjacent to a listener's ear.

Alignment characteristics of magnetic fields have been used to achieve precise movement and positioning of objects, such as in linear actuators, linear and rotation stages, goniometers, and mirror mounts. Magnets with precisely aligned fields or regions are used in packaging machinery, and positioning of valve pilot stages for fluid control systems. They are also used in various commercial products including floppy disk drives, flatbed scanners, printers, plotters and the like. In an example, a magnet, such as a manufactured magnet with programmed, precisely aligned polarity regions, can be used in a magnet and moving coil assembly, such as for a loudspeaker.

SUMMARY

The present inventors have recognized that a problem to be solved includes providing a loudspeaker driver with a magnetic source that provides a linear magnetic field in an airgap for a loudspeaker voice coil over the voice coil's excursion limits. That is, the problem can include providing a linear magnetic field in a region that includes a voice coil's entire expected range of motion. The present inventors have recognized that a solution to the problem can include or use a magnet structure having multiple, differently polarized regions and a magnetic circuit configured to direct flux from the differently polarized regions to opposite sides of an airgap. In an example, the solution can include or use ferromagnetic pole pieces to route flux from the polarized regions to the airgap, and a voice coil can be disposed inside of the airgap. In an example, the voice coil can be underhung or overhung. In an underhung configuration, the voice coil can be substantially retained within the airgap for any or all expected voice coil excitation signals. In an overhung configuration, at least a portion of the voice coil may extend outside of the airgap (e.g., away from the magnet structure) over at least a portion of the voice coil's available excursion.

The present inventors have further recognized that a problem to be solved includes providing a high-fidelity loudspeaker assembly in a compact headphone assembly. The problem can further include providing an extended bass or low frequency response, or listener-perceived bass response, using a compact headphone assembly. The present inventors have recognized that a solution to the problem can include or use a dual loudspeaker driver assembly at each of left and right sides of a headphone. In other words, the solution can include a dual-driver loudspeaker assembly configured to be packaged for use with a headphone assembly and further configured to reproduce sound to be received by a single ear. The inventors have further recognized that the dual driver assembly can use the above-mentioned magnet structure with multiple, differently polarized regions to provide an efficient and compact loudspeaker assembly with an extended low frequency response, and can include using an underhung voice coil for one or both of the drivers. The inventors have further recognized that a manufactured magnet structure can be used, such as a magnet structure that is printed or assembled to provide precisely located boundaries between regions that have different polarities.

The inventors have further recognized that the solution can include damped porting of different acoustic cavities or chambers of a dual-driver loudspeaker assembly to further enhance the assembly's frequency response, including to enhance the assembly's low frequency performance.

In an example, a solution to the above-mentioned problems, among others, can include a headphone assembly with left and right loudspeaker drivers provided in respective left and right ear cups, wherein each ear cup comprises an ear-facing acoustic chamber that abuts an ear when the headphone assembly is worn by a listener and a low frequency acoustic chamber. In an example, each of the left and right loudspeaker drivers comprises a magnet, first and second diaphragm assemblies, and first and second diaphragm supports. The magnet can include an axially magnetized first dipole portion and an axially magnetized second dipole portion, wherein the first dipole portion is adjacent to the second dipole portion at a first boundary, and wherein the first and second dipole portions have oppositely oriented polarities at the first boundary. The first diaphragm assembly can include a first voice coil and a first diaphragm, and the first diaphragm support can be configured to locate the first voice coil from the first diaphragm assembly coaxially with the magnet and adjacent to a first surface of the magnet at the first boundary, wherein the first diaphragm support bounds a portion of a first airspace cavity behind the first diaphragm and bounds a portion of the ear-facing acoustic chamber on an opposite side of the first diaphragm. The second diaphragm assembly can include a second voice coil and a second diaphragm, and the second diaphragm support can be configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a second airspace cavity behind the second diaphragm and bounds a portion of the low frequency acoustic chamber on an opposite side of the second diaphragm. In an example, a first port can be configured to couple the ear-facing acoustic chamber with the low frequency acoustic chamber.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

This detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. The present inventors contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein."

Figure 1:
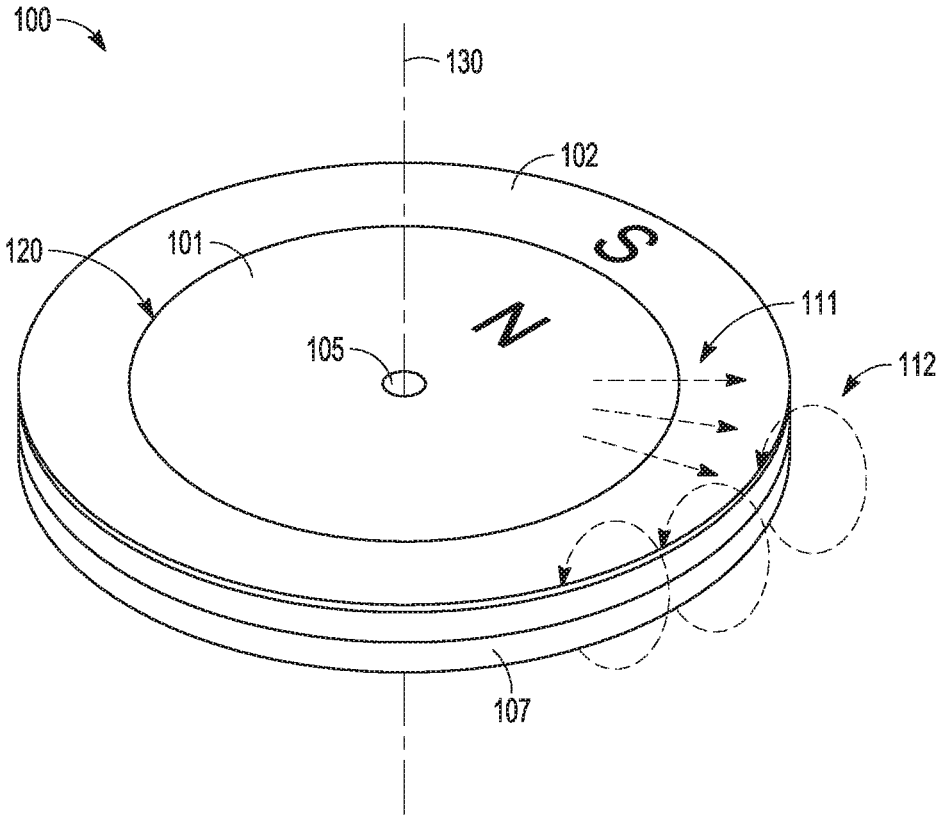
FIG. 1 illustrates generally an example of a magnet structure having multiple dipole portions.

FIG. 1 illustrates generally an example of a magnet structure 100 having multiple dipole portions. In an example, the magnet structure 100 can be used in a loudspeaker driver assembly as further described herein. The magnet structure 100 includes a first dipole portion 101 having a first magnetic polarity, represented by "N" for north in the figure. The magnet structure 100 further includes a second dipole portion 102 having a second magnetic polarity, represented by "S" for south in the figure.

In the example of FIG. 1, the first and second magnetic polarities are provided adjacent to each other on a common face of the magnet structure 100. That is, the first and second dipole portions 101 and 102 are adjacent to each other at a first boundary 120, and a first magnetic field portion 111 extends between the different dipole portions over the boundary 120. Stated differently, a first face of the magnet structure 100 includes the two polarity regions, north and south, corresponding to the first and second dipole portions 101 and 102 at the first face. In an example, an advantage afforded by the different polarity regions on the surface of the magnet structure 100 includes minimizing flux leakage or loss because the field is substantially retained on the structure surface and little or no flux wraps around the sides of the structure to the opposite surface. A further advantage includes that the flux present at the surface of the magnet structure can be routed to a specified location, such as using pole pieces, and as further discussed below.

In the example of FIG. 1, the first dipole portion 101 is a disc-shaped structure that is axially magnetized such that top and bottom sides of the disc-shaped structure have opposite magnetic polarities along a first axis 130. In an example, the first dipole portion 101 includes an outer side edge that corresponds to the first boundary 120. The first dipole portion 101 can be a solid structure or, in an example, can include a through hole at its center along the first axis 130. The second dipole portion 102 can be a ting-shaped structure that is axially magnetized such that top and bottom sides of the ring-shaped structure have opposite magnetic polarities. The second dipole portion 102 can include an inner side edge and an outer side edge. In an example, the inner side edge of the second dipole portion 102 is adjacent to, or abuts, the outer side edge of the first dipole portion 101 at the first boundary 120. In the example of FIG. 1, the first and second dipole portions 101 and 102 form a disc-shaped magnet structure 100.

The first and second dipole portions 101 and 102 can have substantially similar area characteristics. For example, a surface area of a top surface of the first dipole portion 101 can be substantially the same as a surface area of a top surface of the second dipole portion 102 such that each portion represents approximately one half of the total area of a surface of the magnet structure 100. When the areas of the first and second dipole portions 101 and 102 are substantially the same, flux in the first magnetic field portion 111 will extend between the different dipole portions over the boundary 120. If there is an inequality in the areas of the dipole portions, then a portion of the magnetic flux can "leak". In the example of FIG. 1, such a leak is represented by a second magnetic field portion 112. The leak corresponds to flux that can complete around an outer edge of the magnet structure 100. Such leakage can represent a loss of magnetic energy in the circuit when the circuit is used as a portion of a loudspeaker driver, as further described below.

The magnet structure 100 can be formed in various ways. The magnet structure 100 can be a unitary structure formed from a common or homogenous material. The unitary structure can be selectively magnetized or programmed to have discrete regions with different polarities, for example, corresponding to the first and second dipole portions 101 and 102. In such an example, the first boundary 120 represents a portion of the magnet material where the first and second dipole portions 101 and 102 meet. That is, the first and second dipole portions 101 and 102 can have opposed or opposing polarities at the first boundary 120.

In an example, the magnet structure 100 is formed from first and second discrete magnets corresponding to the first and second dipole portions 101 and 102, respectively, and the discrete first and second dipole portions 101 and 102 are assembled and positioned adjacent to each other at the first boundary 120. In an example, the magnet structure includes or uses a rare earth magnet such as high temperature neodymium N50M. Other magnetic materials can similarly be used.

In an example, the magnet structure 100 can include a shunt plate 107. The shunt plate 107 can be a ferromagnetic material that magnetically couples the first and second dipole portions 101 and 102, such as along a bottom surface of the magnet structure 100. The shunt plate 107 can help retain magnetic flux within the magnet structure 100 to prevent losses in magnetic circuit efficiency.

Figure 2:
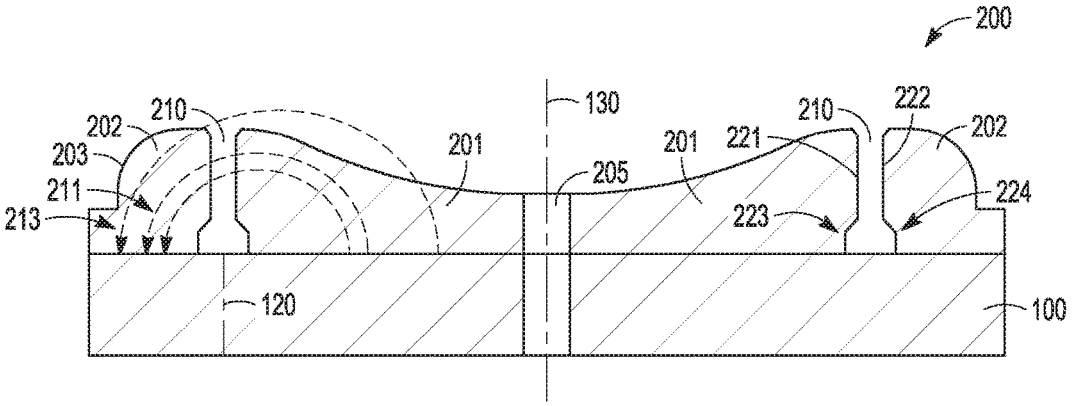
FIG. 2 illustrates generally an example of a cross section view of a magnet structure with pole pieces corresponding to respective dipole portions on a first side of the magnet structure.

FIG. 2 illustrates generally an example 200 of a cross section view of the magnet structure 100 with pole pieces corresponding to respective dipole portions on a first side of the magnet structure 100. In the example 200, a first side of the magnet structure 100 is coupled with, or adjacent to, an inner first pole piece 201 and an outer second pole piece 202. The first and second pole pieces 201 and 202 are configured to route magnetic flux and can be comprised of one or more ferromagnetic materials. For example, steel, iron alloys such as iron cobalt, or Permalloy can be used, among other materials. The first and/or second pole pieces 201 and/or 202 can be affixed to the magnet structure using various mechanical means such as using an adhesive or fastener. For example, a central fastener or pin can be inserted in a through-hole 205 to secure the first pole piece to the magnet structure 100. The magnet structure 100 can optionally be magnetized before or after the pole pieces are secured.

In an example, the first pole piece 201 can be provided adjacent to the first dipole portion 101 of the magnet structure 100, and the second pole piece 202 can be provided adjacent to the second dipole portion 102. Portions of the first and second pole pieces 201 and 202 that do not contact the surface of the magnet structure 100 can be curved or smoothed, such as without abrupt discontinuities or corners that can contribute to flux leakage outside of the magnetic circuit. For example, the second pole piece 202 can include an outer edge 203 that is substantially curved or rounded to help minimize flux leakage and to instead direct flux from the second dipole portion 102 to an airgap 210.

The first and second pole pieces 201 and 202 are spaced apart from each other near the first boundary 120 to form the airgap 210. In an example, the airgap 210 includes a channel that extends perpendicular to a top surface of the magnet structure 100, that is, parallel to the first axis 130 of the first dipole portion 101 of the magnet structure 100. The airgap 210 can include an airgap width that is sufficiently wide to receive a voice coil assembly from a loudspeaker. The airgap 210 width can be selected to accommodate a particular voice coil thickness, however, the width is preferably minimized to limit flux fringing effects. In an example, upper and/or lower corner edges of the airgap 210 can be rounded to further retain flux density and avoid flux dispersion. A height or length characteristic of the airgap 210 can be selected to accommodate a specified voice coil excursion, which can be a function of one or more of a maximum coil current, a number of coil turns, a flux density or magnetic force in the airgap 210, and other factors such as diaphragm material or configuration.

In an example, the first and second pole pieces 201 and 202 carry a first magnetic flux portion 211 from the first dipole portion 101 of the magnet structure 100 to the second dipole portion 102 via the airgap 210. That is, flux from the magnet structure 100 can be routed to and through the airgap 210 using the first and second pole pieces 201 and 202. In an example, a flux transfer between the first and second dipole portions 101 and 102 of the magnet structure 100 can be imperfect and a leakage flux portion 213 can travel outside of the pole pieces.

In the example of FIG. 2, the first and second pole pieces 201 and 202 come together at the airgap 210 to define the side edges or walls of the airgap 210. In an example, the airgap 210 can include substantially straight, vertical walls 221, 222, from the surface of the magnet structure 100 to the tops of the first and second pole pieces 201 and 202. However, such a configuration can route flux in regions that the voice coil may never reach, for example, at or near the surface of the magnet structure 100. Therefore, to maximize a flux density in a region where a voice coil is expected to be or expected to travel, the first pole piece 201 can include a first cutaway region 223 and the second pole pieces 202 can include a second cutaway region 224 near a junction of the magnet structure 100, the airgap 210, and the respective pole pieces. By providing the first and second cutaway regions 223 and 224, more flux can be routed up and through or toward the airgap 210, including in the portion of the airgap 210 that is most likely to have or receive a voice coil.

Figure 3:
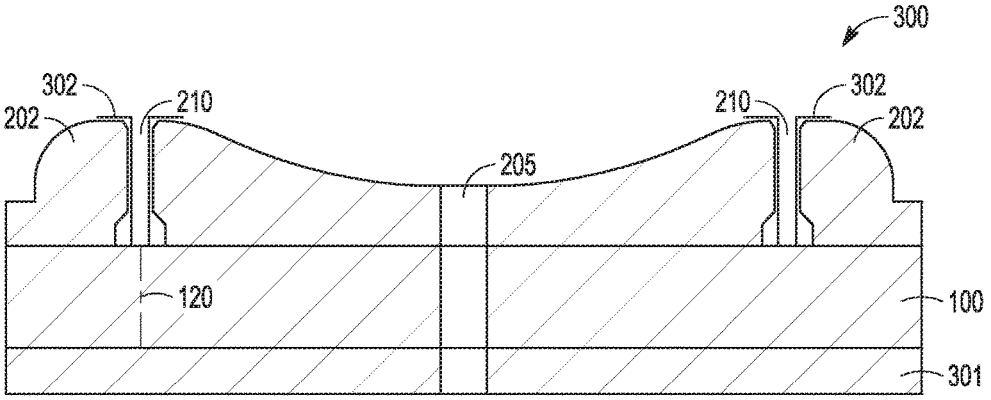
FIG. 3 illustrates generally an example of a cross section view of a magnet structure with multiple pole pieces and a magnetic shunt circuit.

FIG. 3 illustrates generally an example 300 of a cross section view of the magnet structure 100 with multiple pole pieces, a shunt plate 301, and a shorting element 302. The example 300 can include or use the example 200 from FIG. 2, including the magnet structure 100 with the first and second pole pieces 201 and 202 that define the airgap 210. The shunt plate 301 can correspond to the shunt plate 107 from the example of FIG. 1.

The shorting element 302 can be provided at the top and sidewalls of the airgap 210. For example, the shorting element 302 can include a plated ring, such as can be provided on an inside of the airgap 210 near its upper edge. In an example, the shorting element 302 includes a nonferromagnetic, plated surface. The shorting element 302 can help concentrate eddy currents and lower an inductance of the coil. Lower inductance can be advantageous because it can help to provide a more linear, or flatter, frequency response, and can help minimize phase shifting, particularly when two drivers are used together as discussed herein.

Figure 4:
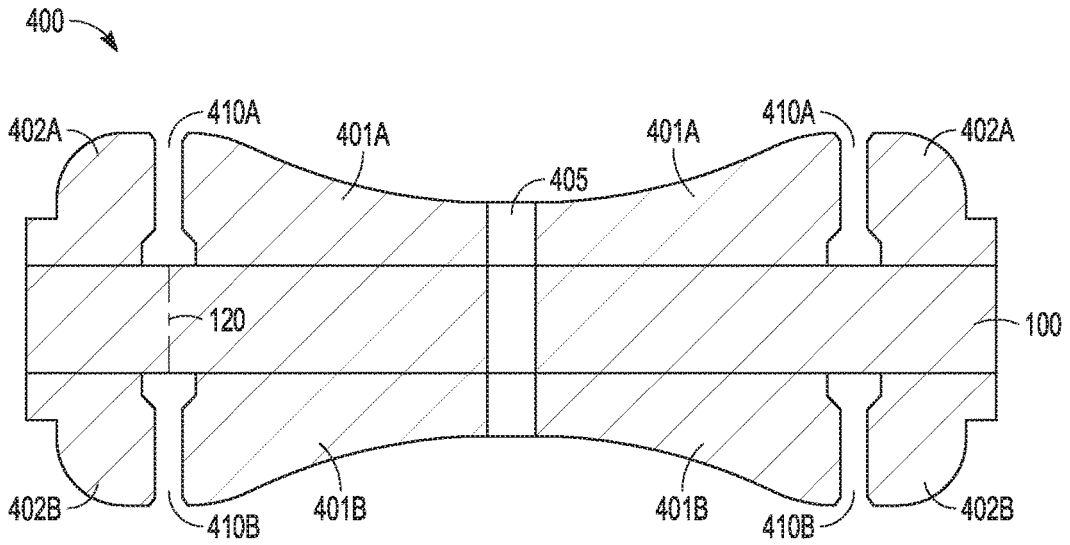
FIG. 4 illustrates generally an example of a cross section view of a magnet structure with pole pieces corresponding to respective dipole portions on first and on opposite second sides of the magnet structure.

FIG. 4 illustrates generally an example 400 of a cross section view of the magnet structure 100 with pole pieces corresponding to respective dipole portions on first and on opposite second sides of the magnet structure 100. In the example of FIG. 4, the magnet structure 100 can be provided without the shunt plate 107 so that pole pieces can be provided on each of opposite sides of the magnet structure 100.

The example 400 of FIG. 4 includes a top first pole piece 401A, and a bottom first pole piece 401B. The top and bottom first pole pieces 401A and 401B cover opposite polarity portions, at opposite surfaces, of the first dipole portion 101 of the magnet structure 100. That is, if the top first pole piece 401A is provided adjacent to a north polarity side of the first dipole portion 101, then the bottom first pole piece 401B is provided adjacent to a south polarity side of the same first dipole portion 101. Similarly, the example 400 includes a top second pole piece 402A and a bottom second pole piece 402B adjacent to south and north polarity sides, respectively, of the second dipole portion 102 of the magnet structure 100.

The example 400 of FIG. 4 further includes a first airgap 410A on a first side of the magnet structure 100, and includes a second airgap 410B on a second side of the magnet structure. In an example, the airgaps have a common central axis, and in other examples, the airgaps do not have a common axis, as further described below and illustrated in FIG. 6.

The example 400 of FIG. 4 further includes a through hole 405 that extends along a central axis of the magnet structure 100, and the top and bottom first pole pieces 401A and 401B. In an example, the through hole 405 can be open and can permit airflow between undersides of diaphragms provided on opposite sides of the magnet structure 100. In another example, the through hole 405 can be open but damped to partially inhibit airflow between the two sides. In yet another example, the through hole 405 can be filled to impede airflow between the two sides, such as with a fastener that can be used to secure the magnet structure 100 to the top and bottom first pole pieces 401A and 401B.

Figure 5:
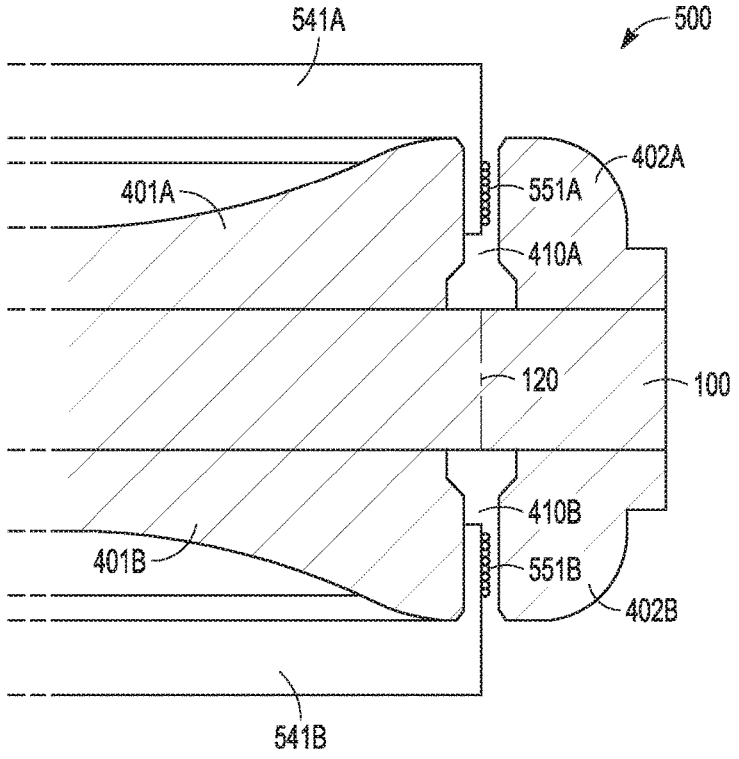
FIG. 5 illustrates generally a cross section view of a first example of voice coils disposed in respective air gaps on opposite sides of a magnet structure.

FIG. 5 illustrates generally a cross section view of a first example 500 of voice coils disposed in respective air gaps on opposite sides of the magnet and pole piece assembly from the example 400 of FIG. 4. FIG. 5 includes a first voice coil assembly 541A, including a first voice coil 551A that is disposed in a first airgap 410A on a first side of the magnet structure 100. The example of FIG. 5 further includes a second voice coil assembly 541B, including a second voice coil 551B that is disposed in a second airgap 410B opposite to the first airgap 410A. The first and second voice coils 551A and 551B are illustrated as a cross section of the windings that form each of the coils. Fewer or additional windings may be used depending on the desired frequency response and sensitivity characteristics of the driver. Although the illustrated coils comprise a single layer of windings, multiple layers can similarly be used. Additionally, although the illustrated coil and magnet assemblies comprise underhung configurations, overhung configurations can similarly be used.

Figure 6:
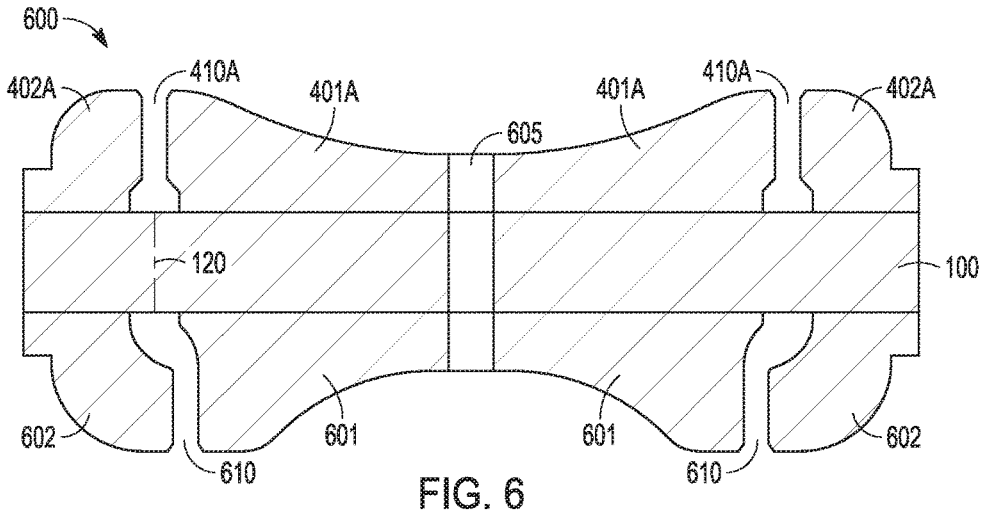
FIG. 6 illustrates generally a cross section view of a second example of voice coils disposed in respective air gaps on opposite sides of a magnet structure.

FIG. 6 illustrates generally a cross section view of a second example 600 of voice coils disposed in respective air gaps on opposite sides of the magnet structure 100. On a first or top side of the magnet structure 100 in the second example 600, the assembly is substantially the same as described above in FIGS. 4 and 5: top first and second pole pieces 401A and 402A are provided adjacent to a first surface of the magnet structure 100 and define a first airgap 410A. In an example, the first airgap 410A can be configured to receive a first voice coil having a first voice coil diameter.

Opposite to the first surface of the magnet structure 100 in the example of FIG. 6, different pole pieces can be used, such as to influence how much flux is routed to another airgap and to influence where that flux is provided. For example, a bottom first pole piece 601 can be differently sized or shaped than the top first pole piece 401A. A bottom second pole piece 602 can be differently sized or shaped than the top second pole piece 402A. The bottom first and second pole pieces 601 and 602 provide a second airgap 610, optionally having different width or depth characteristics as compared to the first airgap 410A. In the example 600, the second airgap 610 can be configured to receive a second voice coil having a second voice coil diameter that is different than the first voice coil diameter. That is, the top and bottom sides of the magnet structure 100 can be configured to receive differently-sized loudspeaker diaphragm and voice coil assemblies and the underlying magnet structure 100 is unchanged from the examples of, e.g., FIGS. 4 and 5.

Differences in loudspeaker diaphragm characteristics and voice coil assembly characteristics can be desired for several reasons. For example, a rearward-facing driver configured for low frequency signal reproduction can be made larger or wider than a forward-facing driver, however both drivers can share a common magnetic core. There can be design tradeoffs, however. Larger diameter voice coils are spread over a larger area and accordingly available flux density in an airgap can be reduced. Performance, overall, can depend on a ratio of the voice coil's diameter and an overall diameter of a given diaphragm, among other factors.

Figure 7:
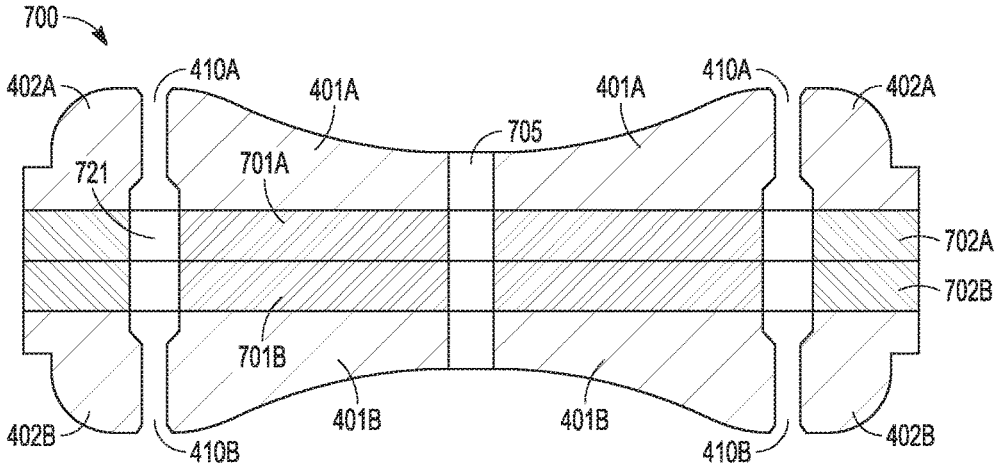
FIG. 7 illustrates generally a cross section view of an example of a magnet structure with magnetized and unmagnetized regions.

FIG. 7 illustrates generally a cross section view of an example 700 of a magnet structure with magnetized and unmagnetized regions. The example 700 can correspond generally to the example of FIG. 4 except for the magnet structure used. In the example of FIG. 7 first and second magnet structures can be provided. Similarly to the magnet structure 100, the first and second magnet structures of FIG. 7 can each include multiple dipole portions, for example, the first structure can include a first dipole portion 701A and a second dipole portion 702A, and the second structure can include a first dipole portion 701B and a second dipole portion 702B. However, in the example of FIG. 7, an unmagnetized zone 721 can be provided at a boundary between the dipole portions.

The unmagnetized zone 721 can extend through the magnet structures such that a non-magnetic gap is provided between the dipole portions of the first and second structures. In an example, a width of the unmagnetized zone 721 corresponds with a width of the airgaps 410A and 410B, which can help to reduce stray flux. In an example, the first and second structures and the unmagnetized zone 721 can be formed using multiple different pieces of magnetized material, or a single material can be used if it is magnetized to define a transition portion or transition material.

Figure 8:
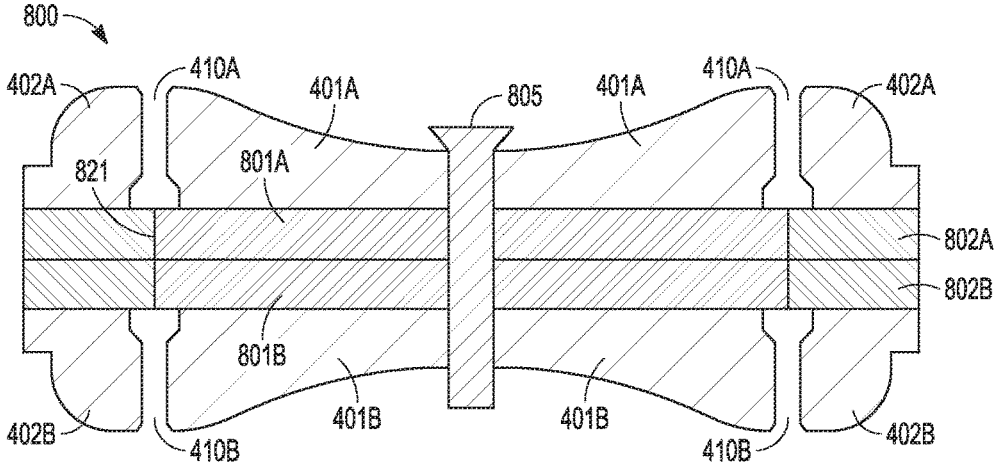
FIG. 8 illustrates generally a cross section view of an example of a magnet structure, multiple pole pieces, and an alignment device.

FIG. 8 illustrates generally a cross section view of an example 800 of a magnet structure, multiple pole pieces, and an alignment device. FIG. 8 is similar to the example of FIG. 7, however the magnetic structures in FIG. 8 do not include an unmagnetized zone.

The example 800 of FIG. 8 can correspond generally to the example of FIG. 4, such as except for the magnet structure used. In the example of FIG. 8, first and second magnet structures can be provided. Similarly to the magnet structure 100, the first and second magnet structures of FIG. 8 can each include multiple dipole portions, for example, the first structure can include a first dipole portion 801A and a second dipole portion 802A, and the second structure can include a first dipole portion 801B and a second dipole portion 802B. In the example of FIG. 8, a boundary 821 exists between the dipole portions, and is generally aligned with at least a base portion of the first and second airgaps 410A and 410B.

The example of FIG. 8 further includes a fastener 805. The fastener 805 can be provided in a through hole that extends along a common central axis of the magnet structures. The fastener 805 can secure together the top and bottom first pole pieces 401A and 401B and the first and second dipole portions 801A and 802A.

Figure 9:
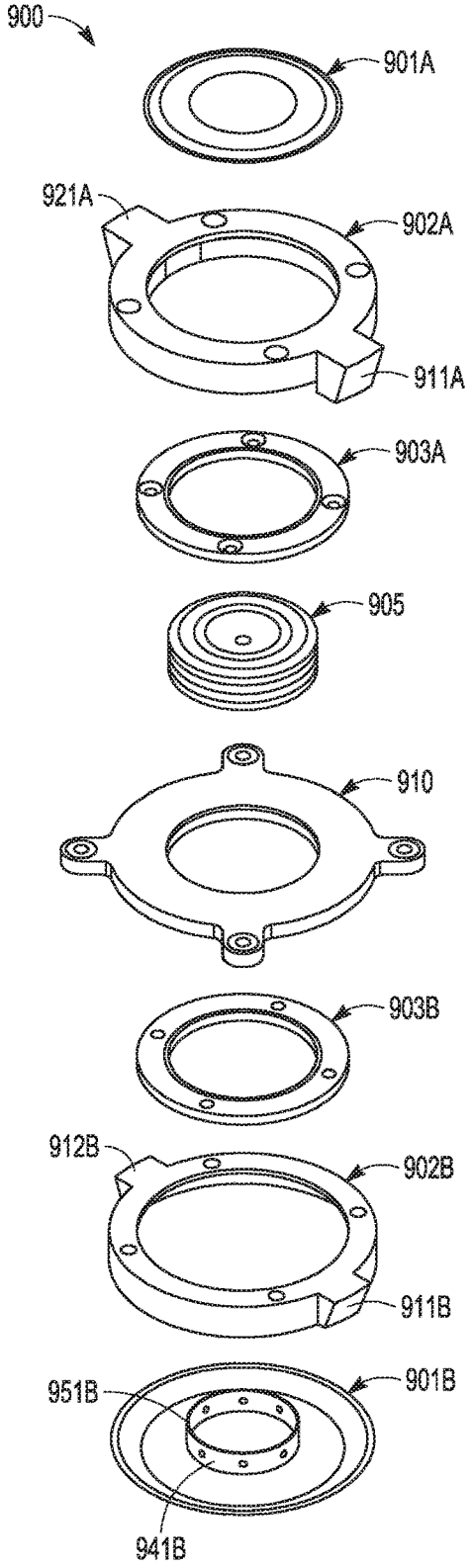
FIG. 9 illustrates generally an exploded view showing components of a first example of a dual-driver loudspeaker assembly with a multiple-pole magnetic structure.
Figure 10:
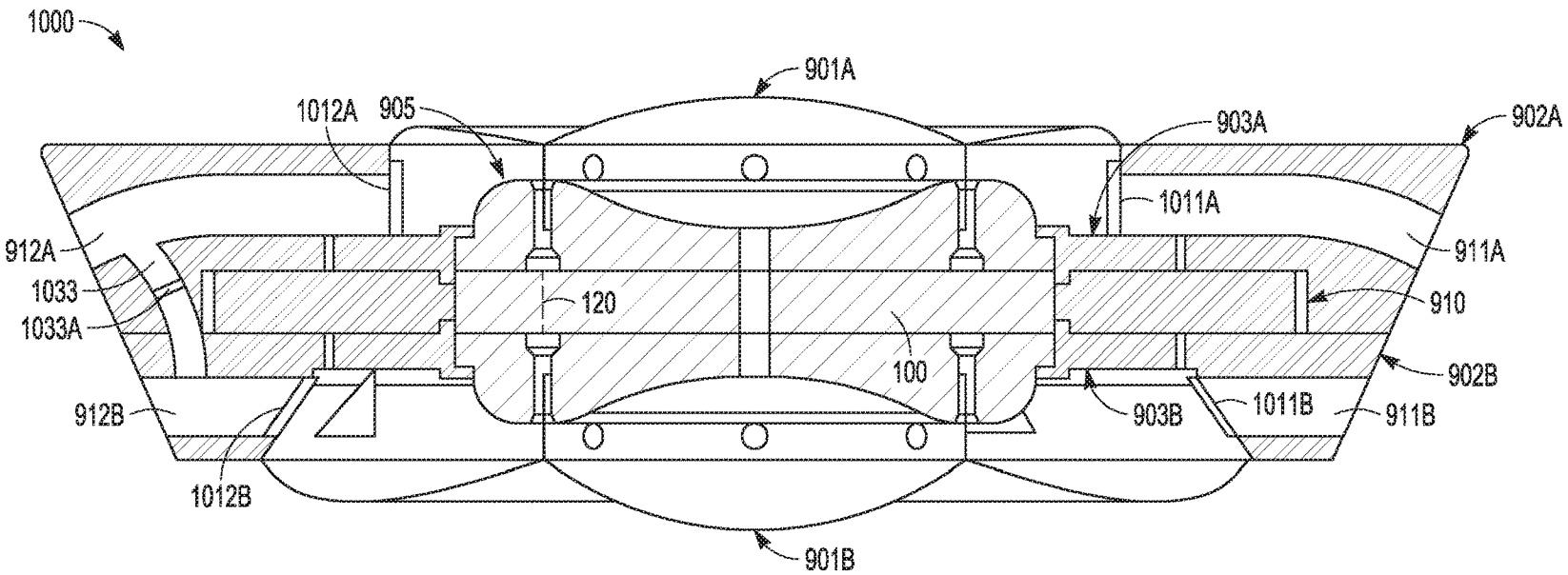
FIG. 10 illustrates generally a section view of an assembled dual-driver loudspeaker with a multiple-pole magnetic structure.

FIG. 9 illustrates generally an example 900 showing an exploded view of components of a first example of a dual-driver loudspeaker assembly with a multiple-pole magnetic structure 905. FIG. 10 illustrates generally a section view of the dual-driver loudspeaker from FIG. 9 in an assembled configured.

Referring first to FIG. 9, the multiple-pole magnetic structure 905 can include the magnet structure 100 and various pole pieces provided on opposing side surfaces of the magnet structure 100. That is, the multiple-pole magnetic structure 905 can include one or more of the assemblies illustrated in the examples of FIGS. 2-8, such as including various unitary or separate magnet structures, pole pieces, and shunt components, among others.

Starting from the middle of the example 900, the multiple-pole magnetic structure 905 can be retained in a magnet support 910, such as using first and second retention rings 903A and 903B. The example 900 further includes first and different second diaphragm assemblies provided on opposite sides of the multiple-pole magnetic structure 905.

In an example, a first diaphragm assembly 901A is provided on a first side of the multiple-pole magnetic structure 905. The first diaphragm assembly 901A includes an assembly configured for reproducing high frequency sound information. For example, the first diaphragm assembly 901A includes a relatively small diaphragm, a lightweight coil and a lightweight coil support. A surround portion of the first diaphragm assembly 901A can be mounted to a first diaphragm support 902A, such as can include first and second side vents 911A and 912A. The first diaphragm support 902A can be coupled to the magnet support 910 or to the first retention ring 903A.

The first and second side vents 911A and 912A can be similarly or differently configured, such as in terms of damping, cross-sectional area, or other characteristics. The first and second side vents 911A and 912A are configured to provide an airway or air path or air communication region between an underside of the first diaphragm assembly 901A and another cavity or ambient environment. For example, when the components of the example 900 are assembled inside of a headphone assembly, then the first and second side vents 911A and 912A can be configured to vent air from the underside of the first diaphragm assembly 901A to an ambient environment outside of the headphone assembly.

In an example, a second diaphragm assembly 901B is provided on a second side of the multiple-pole magnetic structure 905. The second diaphragm assembly 901B includes an assembly configured for reproducing low frequency sound information. For example, the second diaphragm assembly 901B includes a relatively large diaphragm, a coil 951B, and a coil support 941B. A surround portion of the second diaphragm assembly 901B can be mounted to a second diaphragm support 902B, such as can include third and fourth side vents 911B and 912B. The second diaphragm support 902B can be coupled to the magnet support 910 or to the second retention ring 903B.

The third and fourth side vents 911B and 912B can be similarly or differently configured, such as in terms of damping, cross-sectional area, or other characteristics, and further can be similarly or differently configured than the first and second side vents 911A and 912B. The third and fourth side vents 911B and 912B are configured to provide an airway or air path or air communication region between an underside of the second diaphragm assembly 901B and another cavity or ambient environment.

FIG. 10 illustrates generally an example of a section view of an assembled dual-driver loudspeaker 1000 with a multiple-pole magnetic structure. The example can, in some illustrated respects, include an assembled version of the dual-driver loudspeaker assembly from the example 900 of FIG. 9.

In the example of FIG. 10, the first and second side vents 911A and 912A include respective vent dampers 1011A and 1012A. The vent dampers 1011A and 1012A can be configured to selectively allow airflow to pass into or out of a cavity under the first diaphragm assembly 901A. The third and fourth side vents 911B and 912B include respective vent dampers 1011B and 1012B that can be configured to selectively allow airflow to pass into or out of a cavity under the second diaphragm assembly 901B. By adjusting an airflow characteristic in one or both of the vents, a frequency response characteristic of one or both of the drivers in the dual-driver loudspeaker assembly can be changed.

In an example, a first vent chamber 1033 can be provided between the second side vent 912A and the fourth side vent 912B. A vent damper 1033A can optionally be provided in the first vent chamber 1033. A frequency response characteristic of the dual-driver loudspeaker can be changed by adjusting an airflow characteristic in the first vent chamber 1033, such as by adjusting its airspace volume or by adjusting an airflow damping characteristic of the vent damper 1033A.

Additional or fewer dampers can be provided throughout the dual-driver loudspeaker in the example 1000. For example, additional dampers can be provided at an interface between one or more of the vents and an ambient environment. In an example, a damper includes a woven or non-woven cloth having a specified density to control an airflow volume or airflow rate through a port or vent. In an example, a damping characteristic of one or more of the dampers can be adjusted at a time of manufacture to help tune a frequency response of the dual-driver loudspeaker, such as to help mitigate other process variations that can occur.

When the dual-driver loudspeaker 1000 is assembled into a headphone assembly, an ear chamber can be provided between the first diaphragm assembly 901A and the ear. In an example, a second port can be formed from at least one of the first and second side vents 911A and 912A to the ear chamber, such as to further tune the system's frequency response. One or more dampers can be provided in the second port to further adjust the damping.

Figure 11:
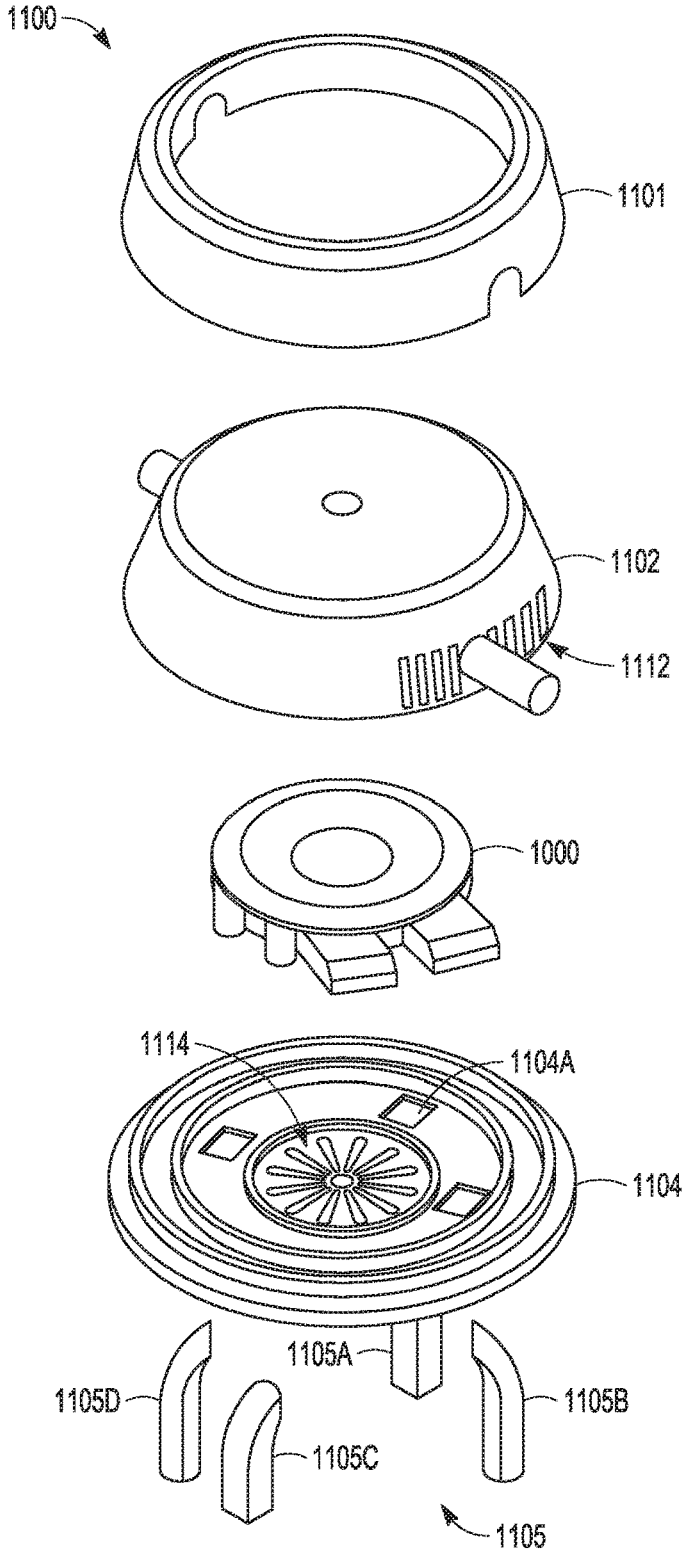
FIG. 11 illustrates generally an exploded view of a portion of a headphone assembly with a dual-driver loudspeaker.

FIG. 11 illustrates generally an example 1100 of an exploded view of a portion of a headphone assembly with a dual-driver loudspeaker. The example 1100 includes the assembled dual-driver loudspeaker 1000 from the example of FIG. 10, with various additional headphone housing components and porting structures. For example, FIG. 11 includes a muffler ring 1101, a rear chamber cup 1102, and an ear chamber cup 1104. The vents in the assembled dual-driver loudspeaker 1000 can be coupled to an ambient environment using various ports 1112 in the rear chamber cup 1102.

In an example, low frequency information reproduced by the larger second diaphragm assembly 901B in the assembled dual-driver loudspeaker 1000 can be received in the rear chamber cup 1102. The rear chamber cup 1102 is sometimes referred to herein as an air cavity, an acoustic chamber, or a resonant chamber. In an example, the low frequency sounds in the rear chamber cup 1102 can be received using multiple bass ports 1105 and communicated to the ear chamber cup 1104 for the listener to hear, such as using through holes 1104A that can accommodate the bass ports 1105. For example, the illustrated bass ports 1105A-1105D can acoustically couple the rear chamber cup 1102 and the ear chamber cup 1104 such that low frequency information can be shared between the chamber areas. Assemblies that include and use the bass ports 1105A-1105D can provide a more "open" or "spacious" sound to a listener, and can induce less pressure on a listeners ear than may be provided by a single-diaphragm design, for example because the low frequency rear driver is partially decoupled from the ear.

Figure 12:
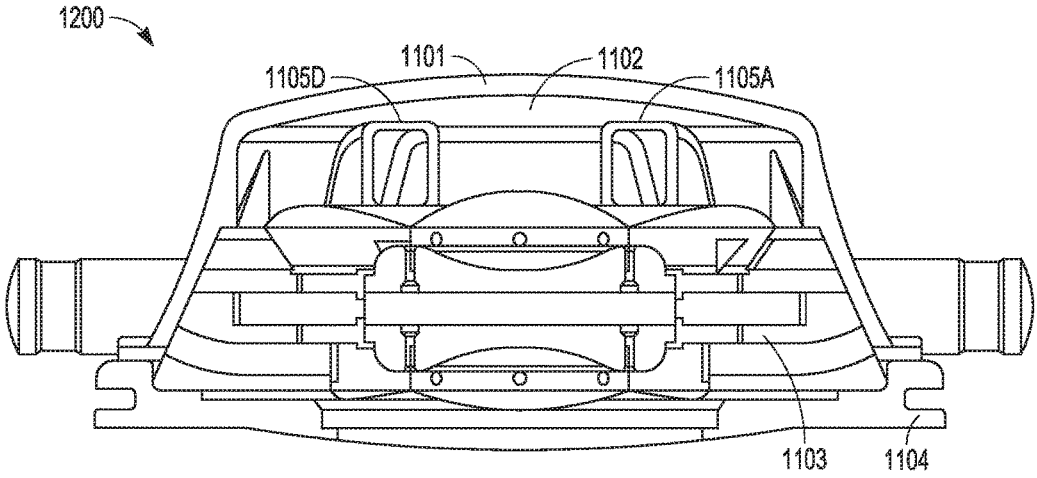
FIG. 12 illustrates generally a section view of an assembled headphone driver assembly with a dual-driver loudspeaker.

FIG. 12 illustrates generally an example 1200 of a section view of an assembled headphone driver assembly with a dual-driver loudspeaker, using the components from the example 1100 of FIG. 11.

Rear acoustic chamber tuning can be customized for user preferences by adjusting a cross-sectional area of one or more of the bass ports 1105A-1105D. For example, smaller cross-sectional area ports can generally filter or attenuate higher frequencies. In an example, tuning for a particular bass range or response can take place during manufacture of the headphone or driver assembly. In another example, consumers can tune their own headphones by inserting and/or removing damping materials to and/or from the tuning ports and vents. In an example, a tuning characteristic for a given headphone assembly can be adjusted by a user.

Vent or port design can be determined based on user preferences or determined general preferences and can be a function of frequency and amplitude. For example, port length affects a port's filter characteristics. In an example, multiple chambers can be used to help filter undesired frequencies, also known as a double bass reflex system. The single bass reflex system has the advantage of being simpler to design and manufacture.

Figure 13:
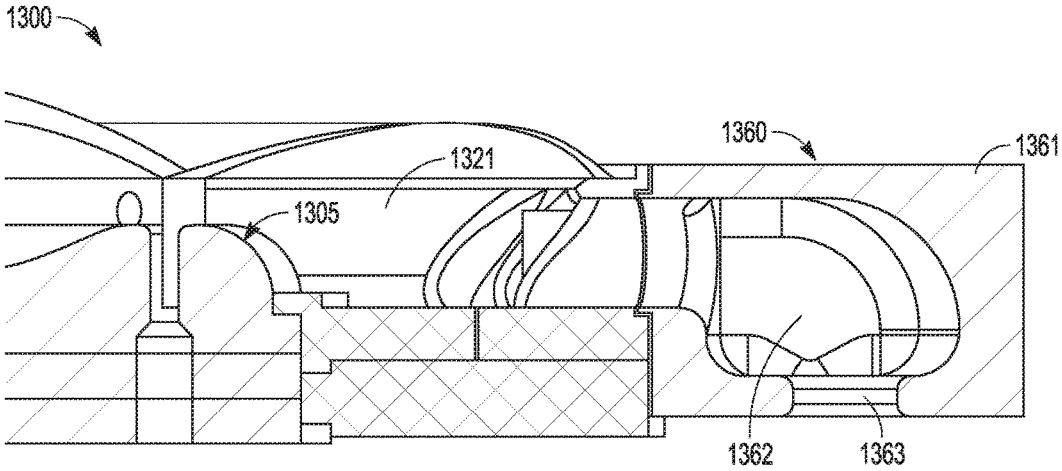
FIG. 13 illustrates generally a portion of a driver assembly with a damping chamber.

FIG. 13 illustrates generally an example 1300 that includes a portion of a driver assembly with a damping chamber 1360. Like the examples described above, the example 1300 can include a multiple pole magnet structure 1305, a loudspeaker diaphragm, and a vent structure 1321 that vents an area behind a diaphragm. A problem can include using the headphone at a volume or sound pressure level that is acceptable to the listener but is disruptive to others, such as when a portion of the sound reproduced using the loudspeaker is vented to an ambient environment. A solution to this problem can include providing an acoustic chamber or damping chamber 1360 to help muffle noise and/or to influence a frequency response of the system. The damping chamber 1360 can be coupled to, and configured to receive airflow from, one or more of the vents or ports in the loudspeaker assembly. For example, the damping chamber 1360 can be coupled to the ports 1112 in the rear chamber cup 1102. In the example of FIG. 13, the damping chamber 1360 is in acoustic communication with and receives airflow from a vent structure 1321.

In an example, the damping chamber 1360 includes a rigid outer wall 1361 and an inner cavity 1362. The inner cavity 1362 can be packed with an acoustically absorptive material such as a low density foam or cotton fluff or similar material that can absorb and disperse sound energy. The inner cavity 1362 can be further coupled to an ambient acoustic environment with a second port 1363, such as to provide limited air exchange between the loudspeaker and the ambient environment. In an example, the damping chamber 1360 can be configured to be snapped into or out of place by a user such that a user can decide when to use or not use the additional damping.

In an example, other user-experience enhancing features can be added. For example, a resonator or vibrating motor can be included or used to help emphasize low frequency information.

In an example, the dual-diaphragm loudspeaker system can be used in noise cancelation applications. For example, an ear-facing driver can be used to provide a primary sound to a listener while an away-facing driver can be used for active noise cancelation. That is, indirect background noise can be canceled by indirect sounds reproduced using a speaker facing away from a listener's ear.

Figure 14:
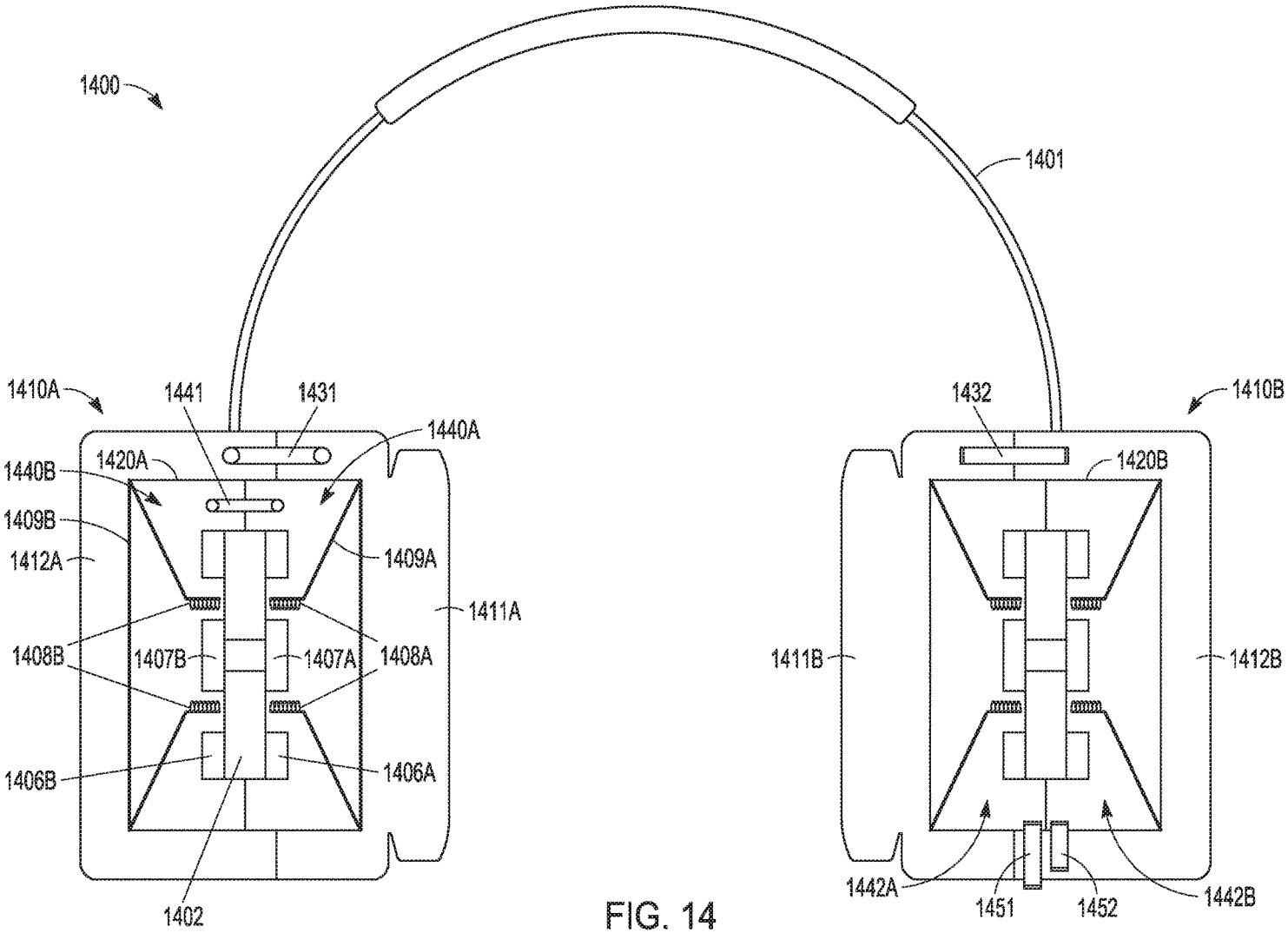
FIG. 14 illustrates generally a schematic diagram of a headphone assembly with dual-driver loudspeakers provided for each of left and right sides of the headphone.

FIG. 14 illustrates generally a schematic diagram of a first headphone assembly 1400 with dual-driver loudspeakers provided at each of left and right sides of the headphone. The dual-driver loudspeakers illustrated in the example of the first headphone assembly 1400 have different porting and venting characteristics for illustrative purposes. Generally, in practice, the left and right side driver assemblies are substantially identically configured.

The first headphone assembly 1400 includes a headband 1401 coupled to a left earphone assembly 1410A and a right earphone assembly 1410B. Each of the left and right earphone assemblies 1410A and 1410B includes (1) a dual-driver loudspeaker assembly (e.g., one of left and right loudspeaker assemblies 1420A, 1420B), (2) an ear-facing acoustic chamber on a first side of the dual-driver loudspeaker assembly (e.g., one of left and right ear-facing acoustic chambers 1411A, 1411B) that abuts an ear when the headphone is worn by a listener, and (3) a low frequency acoustic chamber on a second side of the dual-driver loudspeaker assembly (e.g., one often and right low frequency acoustic chambers 1412A, 1412B).

The dual-driver, left loudspeaker assembly 1420A is described as follows. The same or similar description can be provided regarding the dual-driver, right loudspeaker assembly 1420B but such description is omitted for brevity. In the example, the left loudspeaker assembly 1420A includes a multiple-pole magnet 1402, ring-shaped first and second ferromagnetic flux circuits 1406A and 1406B that are in contact with outer surface portions of the multi-pole magnet 1402, and circular third and fourth ferromagnetic flux circuits 1407A and 1407B in contact with inner surface portions of the multi-pole magnet 1402. A first coil 1408A is provided between the first and third ferromagnetic flux circuits 1406A and 1407A. Depending on a direction of current through the first coil 1408A, a first speaker cone 1409A associated with the first coil 1408A will move toward or away from the multiple-pole magnet 1402. Similarly, a second speaker cone 1409B, provided on an opposite side of the multiple-pole magnet 1402 and associated with the second coil 1408B, moves according to a direction of current through the second coil 1408B.

The example of FIG. 14 illustrates generally different airspaces or cavities in the driver and earphone assemblies, and further illustrates several examples of using ports or vents to provide an air exchange or air passage between such airspaces. For example, the left earphone assembly 1410A includes a first dual-driver loudspeaker assembly 1420A that includes a first driver configured to project acoustic energy toward the ear-facing acoustic chamber 1411A, such as toward a listener's ear, and a second driver configured to project acoustic energy toward the low frequency acoustic chamber 1412A, such as away from a listener's ear. The ear-facing acoustic chamber 1411A and the low frequency acoustic chamber 1412A can be physically isolated from each other using chamber walls or using one or more components of the driver assemblies such as can extend to an inner housing wall of the left headphone assembly 1410A.

In an example, a first port 1431 is provided to communicatively couple the ear-facing acoustic chamber 1411A and the low frequency acoustic chamber 1412A. That is, the first port 1431 can provide an air communication path or opening between the ear-facing acoustic chamber 1411A and the low frequency acoustic chamber 1412A. The first port 1431 can have various length, width, or other damping characteristics to influence a frequency response of the left earphone assembly 1410A. In an example, the first port 1431 has a circular cross section along at least a portion of its length, as illustrated in the example of FIG. 14. In an example, the right earphone assembly 1410B includes a second port 1432 that is provided to communicatively couple the ear-facing acoustic chamber 1411B and the low frequency acoustic chamber 1412B. In the example of FIG. 14, the second port 1432 has a rectangular cross section along at least a portion of its length.

In an example, the first dual-driver loudspeaker assembly 1420A includes a first diaphragm support configured to locate a first diaphragm assembly that includes the first speaker cone 1409A coaxially with the multiple-pole magnet 1402 and adjacent to a first surface of the magnet. The first diaphragm support bounds a portion of a first airspace cavity 1440A behind the first speaker cone 1409A, that is, on a side of the first speaker cone 1409A that is opposite from a firing direction or sound projection direction associated with the first speaker cone 1409A. Similarly, the first dual-driver loudspeaker assembly 1420A includes a second diaphragm support configured to locate a second diaphragm assembly that includes the second speaker cone 1409B coaxially with the multiple-pole magnet 1402 and adjacent to a second surface of the magnet. The second diaphragm support bounds a portion of a second airspace cavity 1440B behind the second speaker cone 1409B, that is, on a side of the second speaker cone 1409B that is opposite from a firing direction or sound projection direction associated with the second speaker cone 1409B. In an example, a second port 1441 communicatively couples the first and second airspace cavities 1440A and 1440B. The second port 1441 can include a substantially open passage between the first and second airspace cavities 1440A and 1440B, or can including acoustic damping configured to inhibit or attenuate airflow between the cavities.

Various other ports or vents can be provided to vent an airspace cavity from behind a diaphragm or speaker cone. For example, the right earphone assembly 1410B includes first and second airspace cavities 1442A and 1442B enclosed behind respective diaphragm assemblies. In the example, a first vent 1451 couples the first airspace cavity 1442A with another airspace, such as one that is external to the right earphone assembly 1410B. A second vent 1452 couples the second airspace cavity 1442B with the low frequency acoustic chamber 1412B. Frequency response, sensitivity, and other characteristics of the earphone assemblies can be tuned based on the selected location and type of venting or porting used.

Any one or more of the vents, ports, or other air passages discussed herein can have a continuous or variable cross-sectional area. The vents, ports, or other air passages can be undamped or can be damped such as using a material selected to attenuate or at least partially inhibit airflow, such as foam or cloth, or can be otherwise tuned to influence a frequency response or sensitivity characteristic of one or more of the drivers discussed herein.

Figure 15:
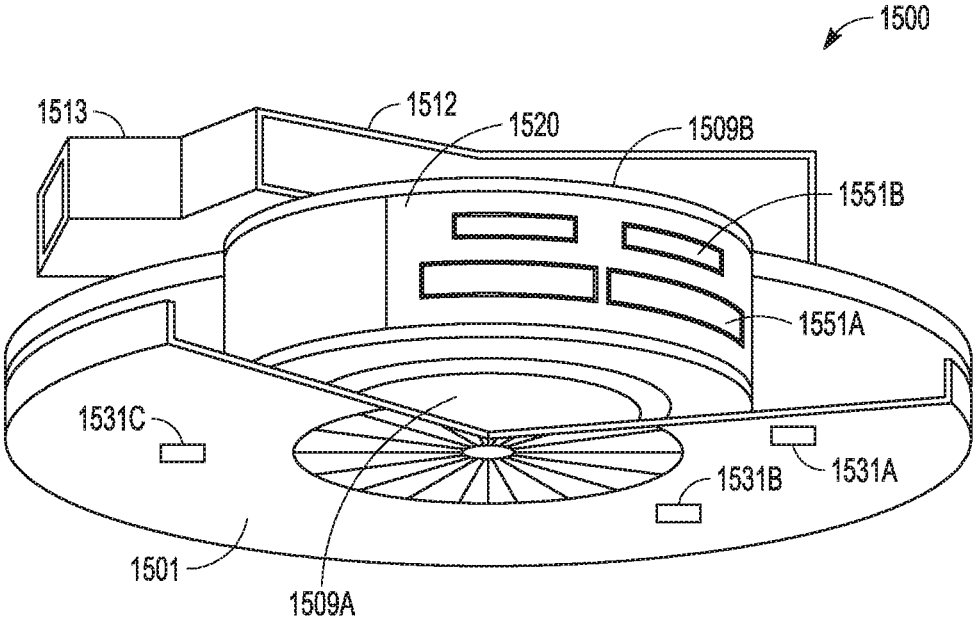
FIG. 15 illustrates generally a cutaway perspective view of an example of a portion of an earphone assembly for a headphone.

FIG. 15 illustrates generally a cutaway perspective view of an example of a portion of an earphone assembly 1500 for a headphone. The assembly 1500 includes a dual-driver loudspeaker assembly 1520, such as can correspond generally to the example of the left loudspeaker assembly 1420A from the example of FIG. 14. In the example of FIG. 15, a high frequency or ear-facing driver, such as including a first diaphragm assembly 1509A, is illustrated facing downward. The example of FIG. 15 includes a low frequency or away-facing driver, such as including a second diaphragm assembly 1509B, and is illustrated facing upward.

The dual-driver loudspeaker assembly 1520 includes first and second vents 1551A and 1551B. The first vent 1551A couples an airspace cavity behind the first diaphragm assembly 1509A with another airspace external to the driver, such as similarly to the example of the first vent 1451 in FIG. 14 that couples the first airspace cavity 1442A with an airspace outside of the right earphone assembly 1410B. The second vent 1551B couples an airspace cavity behind the second diaphragm assembly 1509B with the same or different airspace external to the driver. In an example, a port inside the dual-driver loudspeaker assembly 1520 couples the first and second vents 1551A and 1551B to provide airflow between airspace cavities under the first and second diaphragm assemblies 1509A and 1509B.

In the example of FIG. 15, the second diaphragm assembly 1509B projects sound energy into a low frequency acoustic chamber 1512. The low frequency acoustic chamber 1512 can be vented to another airspace, such as an ambient environment, using a low frequency vent 1513. The low frequency vent 1513 can include damping material to attenuate sound energy leakage from the assembly or to tune a response characteristic of the second diaphragm assembly 1509B.

In the example of FIG. 15, the first diaphragm assembly 1509A is covered by a grille 1501, and the grille 1501 includes multiple through holes that permit sound energy from the first diaphragm assembly 1509A to project into an ear-facing acoustic chamber (not illustrated). In an example, the ear-facing acoustic chamber includes a portion of a headphone or earphone housing and an earcup surround that is configured to be placed against a listeners head, substantially encircling the listener's ear to provide a substantially closed cavity with the listener's head forming a portion of the cavity's boundaries. In an example, the ear-facing acoustic chamber includes communication passages that receive sound energy from the low frequency acoustic chamber 1512. For example, the grille 1501 can include multiple bass ports 1531A, 1531B, 1531C that extend from the ear-facing acoustic chamber to the low frequency acoustic chamber 1512. In the example of FIG. 15, the bass ports have a rectangular cross section, but other configurations can similarly be used. The lengths, and cross-sectional areas, and number of ports can be selected to tune a frequency response characteristic of the system. The bass ports generally extend parallel to an axial direction of one or more components of the dual-driver loudspeaker assembly 1520. For example, the ports can extend substantially parallel to an axis of a multiple-pole magnet structure that comprises a portion of the loudspeaker assembly. In an example, one or more of the ports can be elongated or include a curved path to increase an effective port length between the low frequency acoustic chamber 1512 and the ear-facing acoustic chamber. In an example, the ports can comprise a flexible material such as a silicone or other tubing, and can be configured in various parallel or non-parallel arrangements.

Figure 16:
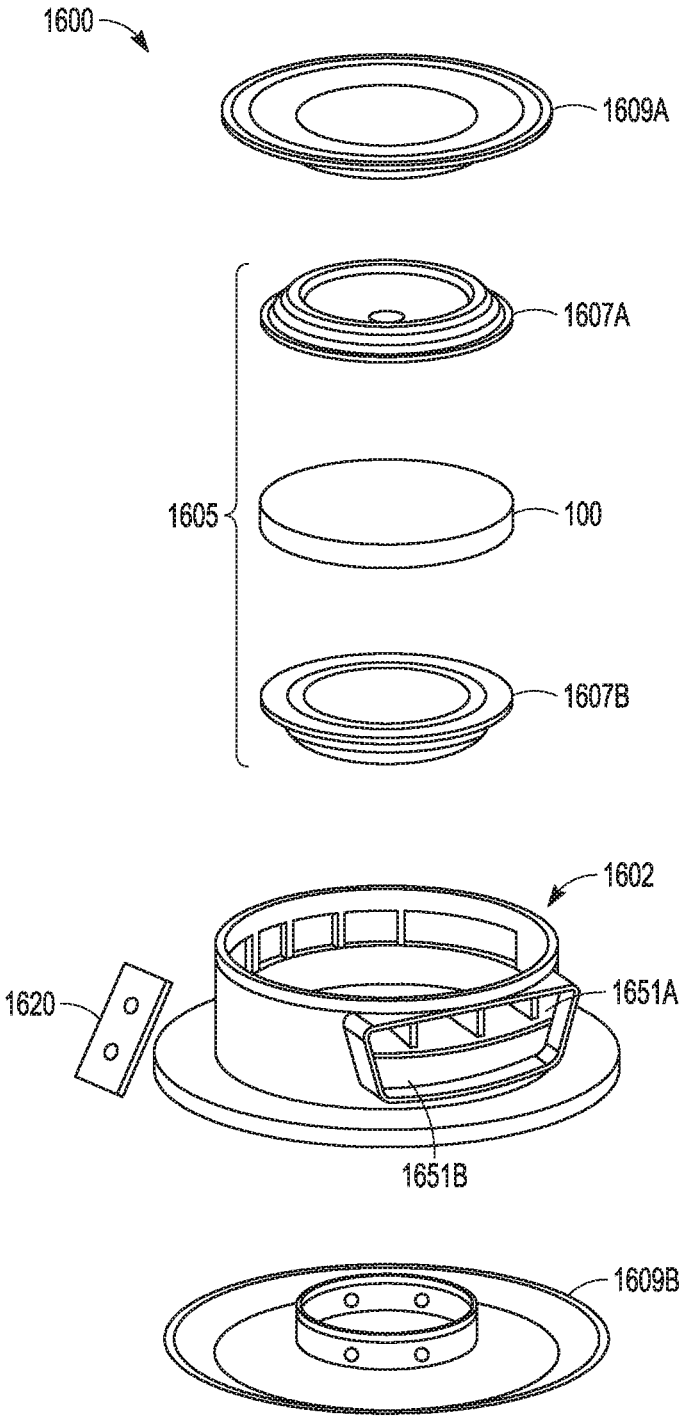
FIG. 16 illustrates generally an example that includes an exploded view of components of a dual-driver loudspeaker assembly.

FIG. 16 illustrates generally an example 1600 that includes an exploded view of components of the dual-driver loudspeaker assembly 1520 from the example of FIG. 15. The example 1600 includes a multiple-pole magnet assembly 1605. In an example, the multiple-pole magnet assembly 1605 includes the magnet structure 100 from the example of FIG. 1. The multiple-pole magnet assembly 1605 can further include a first pole piece assembly 1607A on an ear-facing side of the magnet structure 100, and can include a second pole piece assembly 1607B on an opposite side of the magnet structure 100. The first and second pole piece assemblies 1607A and 1607B can each comprise multiple pole pieces, such as configured to provide sidewall portions of respective airgaps on the ear-facing and opposite sides of the magnet structure 100.

The multiple-pole magnet assembly 1605 can be installed in a diaphragm support structure 1602. First and second diaphragm assemblies 1609A and 1609B can be coupled to opposite sides of the support structure 1602. In an example, the first diaphragm assembly 1609A includes a first diaphragm configured to reproduce relatively midrange or high frequency sounds, and the second diaphragm assembly 1609B includes a differently-dimensioned second diaphragm configured to reproduce relatively lower frequency sounds. Each of the diaphragm assemblies can include a voice coil that is configured to be received in an airgap provided at least in part by pole pieces of the multiple-pole magnet assembly 1605.

When the first and second diaphragm assemblies 1609A and 1609B are affixed to the support structure 1602 with the multiple-pole magnet assembly 1605 interposed between the diaphragm assemblies, there can be provided discrete and distinct airspaces or cavities between each surface of the multiple-pole magnet assembly 1605 and respective corresponding undersides of each of the diaphragms of the first and second diaphragm assemblies 1609A and 1609B. That is, a first airspace cavity can be bounded by the first diaphragm assembly 1609A, a first ear-facing surface of the multiple-pole magnet assembly 1605, and sidewall portions of the support structure 1602. A second airspace cavity can be bounded by the second diaphragm assembly 1609B, a second surface of the multiple-pole magnet assembly 1605 that is opposite to the ear-facing surface, and other sidewall portions of the support structure 1602.

In the example of FIG. 16, the support structure 1602 includes multiple vents. A first vent 1651A can be provided to selectively provide an airflow passage between the first airspace cavity and another airspace outside of the dual-driver loudspeaker assembly 1520. Similarly, a second vent 1651B can selectively provide an airflow passage between the second airspace cavity and the same or another airspace outside of the dual-driver loudspeaker assembly 1520. The first and second vents 1651A and 1651B can be similarly or differently damped to influence response characteristics of the dual-driver loudspeaker assembly 1520.

In an example, the support structure 1602 includes a mounting area for a circuit board 1620. The circuit board 1620 can include various active or passive circuitry for processing signals that can be provided to voice coils of the first and second diaphragm assemblies 1609A and 1609B.

The single and dual-driver loudspeaker systems described herein can be applied other than in headphones. For example, bookshelf speakers, sound bars, automotive speakers, or other sound reproduction devices that can have or necessarily have a thin profile, can be provided using the multiple-pole magnet structure 100, voice coil assemblies, and airspace cavity damping and communication features and techniques described herein.

In an example, the dual diaphragm loudspeaker systems described herein can be used without an electronic equalizer or crossover, and instead each driver can receive a full range of audio signals. The rear chamber and port tuning provided herein can be used to tune the frequency response to nearly any desired profile.

Various Notes

The following Aspects provide a non-limiting overview of the headphone, loudspeaker, and components thereof discussed herein.

Aspect 1 can include or use subject matter (such as an apparatus, a system, or a device), such as can include or use a loudspeaker driver assembly comprising a magnet including an axially magnetized first dipole portion and an axially magnetized second dipole portion, wherein the first dipole portion is adjacent to the second dipole portion at a first boundary, and wherein the first and second dipole portions have opposed polarities at the first boundary. In an example, the opposed polarities at the first boundary can be substantially opposite polarities, or can be oppositionally oriented polarities. Aspect 1 can further include or use a first diaphragm assembly including a first voice coil and a first diaphragm, a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm and bounds a portion of a second airspace cavity on an opposite side of the first diaphragm, a second diaphragm assembly including a second voice coil and a second diaphragm, and a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a third airspace cavity behind the second diaphragm and bounds a portion of a fourth airspace cavity on an opposite side of the second diaphragm. Aspect 1 can further include or use a first port configured to couple the second and fourth airspace cavities.

Aspect 2 can include or use, or can optionally be combined with the subject matter of Aspect 1, to optionally include or use the second airspace cavity, wherein the second airspace cavity comprises a portion of an earcup for a headphone, and wherein the fourth airspace cavity comprises an acoustic chamber for sounds produced by the second diaphragm assembly, and wherein the first port couples the earcup for the headphone with the acoustic chamber.

Aspect 3 can include or use, or can optionally be combined with the subject matter of Aspect 2, to optionally include or use the first port having a rectangular cross section and the first port is configured to pass low frequency sounds from the fourth airspace cavity to the second airspace cavity.

Aspect 4 can include or use, or can optionally be combined with the subject matter of one or any combination of Aspects 1 through 3 to optionally include or use multiple ports configured to couple the second and fourth airspace cavities, wherein the multiple ports extend parallel to a common axial direction of the first and second diaphragm assemblies.

Aspect 5 can include or use, or can optionally be combined with the subject matter of one or any combination of Aspects 1 through 4 to optionally include or use a vent coupling at least one of the first and third airspace cavities with an ambient airspace external to the driver assembly.

Aspect 6 can include or use, or can optionally be combined with the subject matter of Aspect 5, to optionally include or use the vent, wherein the vent couples the first and third airspace cavities with the ambient airspace.

Aspect 7 can include or use, or can optionally be combined with the subject matter of Aspect 5, to optionally include or use the vent, wherein the vent extends substantially parallel to the first surface of the magnet.

Aspect 8 can include or use, or can optionally be combined with the subject matter of one or any combination of Aspects 1 through 7 to optionally include or use a vent configured to couple the first and third airspace cavities.

Aspect 9 can include or use, or can optionally be combined with the subject matter of Aspect 8, to optionally include or use the vent, and the vent includes a through-hole that extends through the magnet.

Aspect 10 can include or use, or can optionally be combined with the subject matter of one or any combination of Aspects 1 through 9 to optionally include or use the first and second diaphragm assemblies being differently dimensioned and each is configured to reproduce respective different audio frequency signals.

Aspect 11 can include or use, or can optionally be combined with the subject matter of Aspect 10, to optionally include or use the second diaphragm assembly configured to reproduce lower frequency audio signals than the first diaphragm assembly.

Aspect 12 can include or use, or can optionally be combined with the subject matter of one or any combination of Aspects 1 through 11 to optionally include or use first and second magnetic flux routing circuits provided on the first and second surfaces of the magnet, respectively, wherein the first magnetic flux routing circuit comprises pole pieces that form sides of a first voice coil gap configured to receive the first voice coil, and wherein the second magnetic flux routing circuit comprises pole pieces that form sides of a second voice coil gap configured to receive the second voice coil.

Aspect 13 can include or use, or can optionally be combined with the subject matter of Aspect 12, to optionally include or use the first and second voice coils with respective different diameters.

Aspect 14 can include or use, or can optionally be combined with the subject matter of Aspect 12, to optionally include or use the first magnetic flux routing circuit including an inner disc-shaped pole piece with a curved upper surface.

Aspect 15 can include or use, or can optionally be combined with the subject matter of Aspect 14, to optionally include or use the first magnetic flux routing circuit including an outer ring-shaped pole piece with a curved upper surface that extends from a cylindrical outer edge of the magnet to an outer edge of the first voice coil gap.

Aspect 16 can include or use, or can optionally be combined with the subject matter of one or any combination of Aspects 1 through 15 to optionally include or use the first and second dipole portions of the magnet having respective regions that have substantially the same surface area to minimize a flux leakage from the magnet.

Aspect 17 can include or use, or can optionally be combined with the subject matter of one or any combination of Aspects 1 through 16 to optionally include or use the magnet including first and second magnet structures, wherein the first diaphragm assembly is configured to be driven in part using flux from the first magnet structure and wherein the second diaphragm assembly is configured to be driven in part using flux from the second magnet structure.

Aspect 18 can include, or can optionally be combined with the subject matter of one or any combination of Aspects 1 through 17 to include or use, subject matter (such as an apparatus, a system, or a device), such as can include or use a loudspeaker driver assembly comprising a magnet including an axially magnetized first dipole portion and an axially magnetized second dipole portion, wherein the first dipole portion is adjacent to the second dipole portion at a first boundary, and wherein the first and second dipole portions have oppositely oriented polarities at the first boundary. Aspect 18 can include or use a first diaphragm assembly including a first voice coil and a first diaphragm, and a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm. Aspect 18 can include or use a second diaphragm assembly including a second voice coil and a second diaphragm, and a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a second airspace cavity behind the second diaphragm. In Aspect 18, at least one of the first and second diaphragm supports includes a vent that couples a respective one of the first and second airspace cavities with a third airspace adjacent to the loudspeaker driver assembly.

Aspect 19 can include or use, or can optionally be combined with the subject matter of Aspect 18, to optionally include or use the first diaphragm support including a first vent that couples the first airspace cavity with the third airspace and wherein the second diaphragm support includes a different second vent that couples the second airspace cavity with the third airspace.

Aspect 20 can include or use, or can optionally be combined with the subject matter of Aspect 19, to optionally include or use the first and second vents being differently dimensioned or differently damped to provide different airflow characteristics between the third airspace cavity and respective ones of the first and second airspace cavities.

Aspect 21 can include or use, or can optionally be combined with the subject matter of Aspect 19, to optionally include or use a first vent that couples the first and second airspace cavities.

Aspect 22 can include or use, or can optionally be combined with the subject matter of Aspect 21, to optionally include or use the first vent extending through the magnet in an axial direction of the magnet.

Aspect 23 can include or use, or can optionally be combined with the subject matter of one or any combination of Aspects 18 through 22 to optionally include or use the first and second diaphragm assemblies having different voice coil or diaphragm characteristics.

Aspect 24 can include or use, or can optionally be combined with the subject matter of one or any combination of Aspects 18 through 23 to optionally include or use an earphone cup that is configured to provide a substantially airtight enclosure that includes the first, second, and third airspaces when the earphone cup is positioned against an ear region of a user.

Aspect 25 can include or use, or can optionally be combined with the subject matter of one or any combination of Aspects 18 through 24 to optionally include or use the vent extending substantially parallel to the first surface of the magnet.

Aspect 26 can include, or can optionally be combined with the subject matter of one or any combination of Aspects 1 through 25 to include or use, subject matter (such as an apparatus, a system, or a device), such as can include or use a headphone assembly with left and right loudspeaker drivers provided in respective left and right ear cups, wherein each ear cup comprises an ear-facing acoustic chamber that abuts an ear when the headphone assembly is worn by a listener and a low frequency acoustic chamber. In Aspect 26, each of the left and right loudspeaker drivers comprises a magnet including an axially magnetized first dipole portion and an axially magnetized second dipole portion, wherein the first dipole portion is adjacent to the second dipole portion at a first boundary, and wherein the first and second dipole portions have oppositely oriented polarities at the first boundary, a first diaphragm assembly including a first voice coil and a first diaphragm, a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm and bounds a portion of the ear-facing acoustic chamber on an opposite side of the first diaphragm, a second diaphragm assembly including a second voice coil and a second diaphragm, a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a second airspace cavity behind the second diaphragm and bounds a portion of the low frequency acoustic chamber on an opposite side of the second diaphragm, and a first port configured to couple the ear-facing acoustic chamber with the low frequency acoustic chamber.

Aspect 27 can include or use, or can optionally be combined with the subject matter of Aspect 26, to optionally include or use the first port having a rectangular cross section and the first port is configured to pass low frequency sound signals from the low frequency acoustic chamber to the ear-facing acoustic chamber.

Aspect 28 can include or use, or can optionally be combined with the subject matter of one or any combination of Aspects 26 or 27 to optionally include or use multiple ports configured to couple the ear-facing acoustic chamber with the low frequency acoustic chamber, wherein the multiple ports extend parallel to a common axial direction of the first and second diaphragm assemblies.

Aspect 29 can include or use, or can optionally be combined with the subject matter of one or any combination of Aspects 26 through 28 to optionally include or use a vent coupling at least one of the first and second airspace cavities with an ambient airspace external to the headphone assembly.

Aspect 30 can include or use, or can optionally be combined with the subject matter of one or any combination of Aspects 26 through 29 to optionally include or use a first vent coupling the first airspace cavity with a different third airspace, and a second vent coupling the second airspace cavity with the third airspace, wherein the first and second vents are differently dimensioned or have different airflow damping characteristics.

Aspect 31 can include or use, or can optionally be combined with the subject matter of one or any combination of Aspects 26 through 30 to optionally include or use the first and second dipole portions of the magnet having respective regions that have substantially the same surface area to minimize a flux leakage from the magnet.

Each of these non-limiting Aspects can stand on its own, or can be combined in various permutations or combinations with one or more of the other Aspects and examples discussed herein.

In the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 CFR. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A loudspeaker driver assembly comprising:

a magnet including an axially magnetized first dipole portion and an axially magnetized second dipole portion, wherein the first dipole portion is adjacent to the second dipole portion at a first boundary, and wherein the first and second dipole portions have opposed polarities at the first boundary;

a first diaphragm assembly including a first voice coil and a first diaphragm;

a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm and bounds a portion of a second airspace cavity on an opposite side of the first diaphragm;

a second diaphragm assembly including a second voice coil and a second diaphragm;

a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a third airspace cavity behind the second diaphragm and bounds a portion of a fourth airspace cavity on an opposite side of the second diaphragm; and a first port configured to couple the second and fourth airspace cavities.

2. The loudspeaker driver assembly of claim 1, wherein the second airspace cavity comprises a portion of an earcup for a headphone, and wherein the fourth airspace cavity comprises an acoustic chamber for sounds produced by the second diaphragm assembly, and wherein the first port couples the earcup for the headphone with the acoustic chamber.

3. The loudspeaker driver assembly of claim 2, wherein the first port includes a rectangular cross section and the first port is configured to pass low frequency sounds from the fourth airspace cavity to the second airspace cavity.

4. The loudspeaker driver assembly of claim 1, further comprising multiple ports configured to couple the second and fourth airspace cavities, wherein the multiple ports extend parallel to a common axial direction of the first and second diaphragm assemblies.

5. The loudspeaker driver assembly of claim 1, further comprising a vent coupling at least one of the first and third airspace cavities with an ambient airspace external to the driver assembly.

6. The loudspeaker driver assembly of claim 5, wherein the vent couples the first and third airspace cavities with the ambient airspace.

7. The loudspeaker driver assembly of claim 1, further comprising a vent configured to couple the first and third airspace cavities.

8. The loudspeaker driver assembly of claim 7, wherein the vent includes a through-hole that extends through the magnet.

9. The loudspeaker driver assembly of claim 1, wherein the first and second diaphragm assemblies are differently dimensioned and each is configured to reproduce respective different audio frequency signals.

10. The loudspeaker driver assembly of claim 1, further comprising first and second magnetic flux routing circuits provided on the first and second surfaces of the magnet, respectively, wherein the first magnetic flux routing circuit comprises pole pieces that form sides of a first voice coil gap configured to receive the first voice coil, and wherein the second magnetic flux routing circuit comprises pole pieces that form sides of a second voice coil gap configured to receive the second voice coil.

11. The loudspeaker driver assembly of claim 10, wherein the first magnetic flux routing circuit includes an inner disc-shaped pole piece with a curved upper surface, and an outer ring-shaped pole piece with a curved upper surface that extends from a cylindrical outer edge of the magnet to an outer edge of the first voice coil gap.

12. The loudspeaker driver assembly of claim 1, wherein the first and second dipole portions of the magnet comprise respective regions that have substantially the same surface area to minimize a flux leakage from the magnet.

13. A loudspeaker driver assembly comprising:

a magnet including an axially magnetized first dipole portion and an axially magnetized second dipole portion, wherein the first dipole portion is adjacent to the second dipole portion at a first boundary, and wherein the first and second dipole portions have opposed polarities at the first boundary;

a first diaphragm assembly including a first voice coil and a first diaphragm;

a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm;

a second diaphragm assembly including a second voice coil and a second diaphragm; and a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a second airspace cavity behind the second diaphragm;

wherein at least one of the first and second diaphragm supports includes a vent that couples a respective one of the first and second airspace cavities with a third airspace adjacent to the loudspeaker driver assembly.

14. The loudspeaker driver assembly of claim 13, wherein the first diaphragm support includes a first vent that couples the first airspace cavity with the third airspace and wherein the second diaphragm support includes a different second vent that couples the second airspace cavity with the third airspace.

15. The loudspeaker driver assembly of claim 14, wherein the first and second vents are differently dimensioned or differently damped to provide different airflow characteristics between the third airspace cavity and respective ones of the first and second airspace cavities.

16. The loudspeaker driver assembly of claim 13, further comprising an earphone cup that is configured to provide a substantially airtight enclosure that includes the first, second, and third airspaces when the earphone cup is positioned against an ear region of a user.

17. A headphone assembly with left and right loudspeaker drivers provided in respective left and right ear cups, wherein each ear cup comprises an ear-facing acoustic chamber that abuts an ear when the headphone assembly is worn by a listener and a low frequency acoustic chamber, wherein each of the left and right loudspeaker drivers comprises:

a magnet including an axially magnetized first dipole portion and an axially magnetized second dipole portion, wherein the first dipole portion is adjacent to the second dipole portion at a first boundary, and wherein the first and second dipole portions have opposed polarities at the first boundary;

a first diaphragm assembly including a first voice coil and a first diaphragm;

a first diaphragm support configured to locate the first voice coil from the first diaphragm assembly coaxially with the magnet and adjacent to a first surface of the magnet at the first boundary, wherein the first diaphragm support bounds a portion of a first airspace cavity behind the first diaphragm and bounds a portion of the ear-facing acoustic chamber on an opposite side of the first diaphragm;

a second diaphragm assembly including a second voice coil and a second diaphragm;

a second diaphragm support configured to locate the second voice coil from the second diaphragm assembly coaxially with the magnet and adjacent to a second surface of the magnet at the first boundary, wherein the second surface of the magnet is opposite to the first surface of the magnet, and wherein the second diaphragm support bounds a portion of a second airspace cavity behind the second diaphragm and bounds a portion of the low frequency acoustic chamber on an opposite side of the second diaphragm; and a first port configured to couple the ear-facing acoustic chamber with the low frequency acoustic chamber.

18. The headphone assembly of claim 17, further comprising multiple ports configured to couple the ear-facing acoustic chamber with the low frequency acoustic chamber, wherein the multiple ports extend parallel to a common axial direction of the first and second diaphragm assemblies.

19. The headphone assembly of claim 17, further comprising a vent coupling at least one of the first and second airspace cavities with an ambient airspace external to the headphone assembly.

20. The headphone assembly of claim 17, further comprising:

a first vent coupling the first airspace cavity with a different third airspace; and a second vent coupling the second airspace cavity with the third airspace;

wherein the first and second vents are differently dimensioned or have different airflow damping characteristics.

* * * * *